US011205406B2

(12) United States Patent
Chern

(10) Patent No.: US 11,205,406 B2
(45) Date of Patent: Dec. 21, 2021

(54) ACCESSORY ASSEMBLY FOR STRING INSTRUMENT AND STRING INSTRUMENT

(71) Applicant: Chyh-Hong Chern, Taipei (TW)

(72) Inventor: Chyh-Hong Chern, Taipei (TW)

( * ) Notice: Subject to any disclaimer, the term of this patent is extended or adjusted under 35 U.S.C. 154(b) by 0 days.

(21) Appl. No.: 16/822,445

(22) Filed: Mar. 18, 2020

(65) Prior Publication Data

US 2021/0295804 A1 Sep. 23, 2021

(51) Int. Cl.
*G10D 3/02* (2006.01)
*G10D 3/13* (2020.01)
*G10D 3/18* (2020.01)

(52) U.S. Cl.
CPC ..... *G10D 3/02* (2013.01); *G10D 3/13* (2020.02); *G10D 3/18* (2013.01)

(58) Field of Classification Search
CPC ..... G10D 3/02; G10D 3/13; G10D 3/18
See application file for complete search history.

(56) References Cited

U.S. PATENT DOCUMENTS 187,996 A * 3/1877 Bridge ..... G10D 3/18 84/279
651,436 A * 6/1900 Coffron ..... G10D 3/18 84/278
1,431,250 A * 10/1922 Oettinger ..... G10D 3/14 84/302
1,971,552 A * 8/1934 Fisher ..... G10D 3/18 84/278
2,234,218 A * 3/1941 Abrams ..... G10D 3/14 84/312 R
2,322,137 A * 6/1943 Jauch ..... G10D 3/14 84/312 R
2,416,593 A * 2/1947 Proll ..... G10D 3/14 84/297 R
2,697,374 A * 12/1954 Ungh ..... G10D 3/18 84/280
3,479,916 A * 11/1969 Wolf ..... G10D 3/18 84/280
3,683,098 A * 8/1972 Abraham Chavez, Jr. ..... G10D 3/18 84/278
3,727,509 A * 4/1973 Henkle ..... G10D 3/18 84/278
D287,137 S * 12/1986 Bushman ..... D17/20
4,739,689 A * 4/1988 Cacioppo ..... G10D 3/18 84/328

(Continued)

FOREIGN PATENT DOCUMENTS

KR 10-2012-0019966 A 3/2012

OTHER PUBLICATIONS

Korean Office Action, dated May 30, 2021, for counterpart Korean Application No. 10-2020-0039584. The Office Action is in Korean, which I cannot read.

*Primary Examiner* — Robert W Horn
(74) *Attorney, Agent, or Firm* — Birch, Stewart, Kolasch & Birch, LLP

(57) ABSTRACT

Multiple accessory assemblies for a string instrument are disclosed. The accessory assembly is a set of an accessory, made of a material of Young's modulus greater than 12 GPa, and at least one sound purifier, made of a material of Young's modulus roughly equal to or less than 3.5 GPa. A string instrument that includes at least one accessory assembly is also discussed.

6 Claims, 6 Drawing Sheets

(56) References Cited

U.S. PATENT DOCUMENTS

| | | | | | |
|---|---|---|---|---|---|
| 5,567,893 | A * | 10/1996 | Kun | G10D 3/18 | 84/280 |
| 5,883,315 | A * | 3/1999 | Kaplan | G10D 3/18 | 84/279 |
| 6,667,430 | B1 * | 12/2003 | Liao | G10D 3/18 | 84/278 |
| 6,927,328 | B2 * | 8/2005 | Anderson | G10D 3/18 | 84/278 |
| 7,304,225 | B2 * | 12/2007 | Ricci | G10D 3/12 | 84/302 |
| RE42,419 | E | 6/2011 | Anderson | | |
| D730,435 | S * | 5/2015 | Turner | D17/20 | |
| 9,299,327 | B1 * | 3/2016 | Steinberger | G10D 3/18 | |
| 9,336,756 | B2 * | 5/2016 | Vochezer | G10D 3/18 | |
| 9,495,942 | B2 * | 11/2016 | Vochezer | G10D 3/18 | |
| 9,741,321 | B1 * | 8/2017 | Heuss | G10H 3/185 | |
| 10,360,879 | B2 * | 7/2019 | Bailey | G10G 5/005 | |
| 2007/0095194 | A1 * | 5/2007 | Moerth | G10D 3/14 | 84/452 R |

* cited by examiner

ACCESSORY ASSEMBLY FOR STRING INSTRUMENT AND STRING INSTRUMENT

FIELD

The disclosure relates to an accessory assembly for a string instrument and more specifically to an accessory assembly with a sound purifier for a string instrument.

BACKGROUND

Quality of string musical instruments, for example, violins, violas, cellos, and basses, has significant effect on the sound these musical instruments produce. Since better instruments for players are in high demand, a great deal of research has been done to understand the secrets behind making the instruments from legendary luthiers, for example, Stradivarius and Guarneri del Gesu. However, every accessory affects the sound quality of the string instrument in one way or another. For example, in many occasions, players use a chinrest on their instruments for properly fitting their chins and necks to the instruments. Fine tuners are applied for tuning the string frequency precisely. The string(s), the tailpiece, and the peg(s) have to be renewed from time to time to maintain the best sound condition. All of them vibrate together as an instrument is being played. The sound of the instrument is actually the combination of these vibrations.

SUMMARY

Therefore, an object of the disclosure is to provide an accessory assembly for a string instrument that improves the tonal quality of the instrument sound.

The string instrument includes a body. The accessory assembly includes an accessory and at least one sound purifier. The accessory is configured to be installed on the body and is made of a material of Young's modulus greater than 12 GPa. Each of the at least one sound purifier is made of a material of Young's modulus less than 3.5 GPa and is configured to be sandwiched between the accessory and the body.

Another object of the disclosure is to provide a string instrument that improves the tonal quality thereof.

According to one embodiment of the disclosure, the string instrument includes a body, an accessory installed on the body and made of a material of Young's modulus greater than 12 GPa, and at least one sound purifier. Each of the at least one sound purifier is made of a material of Young's modulus less than 3.5 GPa and is sandwiched between the accessory and the body.

BRIEF DESCRIPTION OF THE DRAWINGS

Other features and advantages of the disclosure will become apparent in the following detailed description of the embodiment (s) with reference to the accompanying drawings, of which.

DETAILED DESCRIPTION

Figure 1:
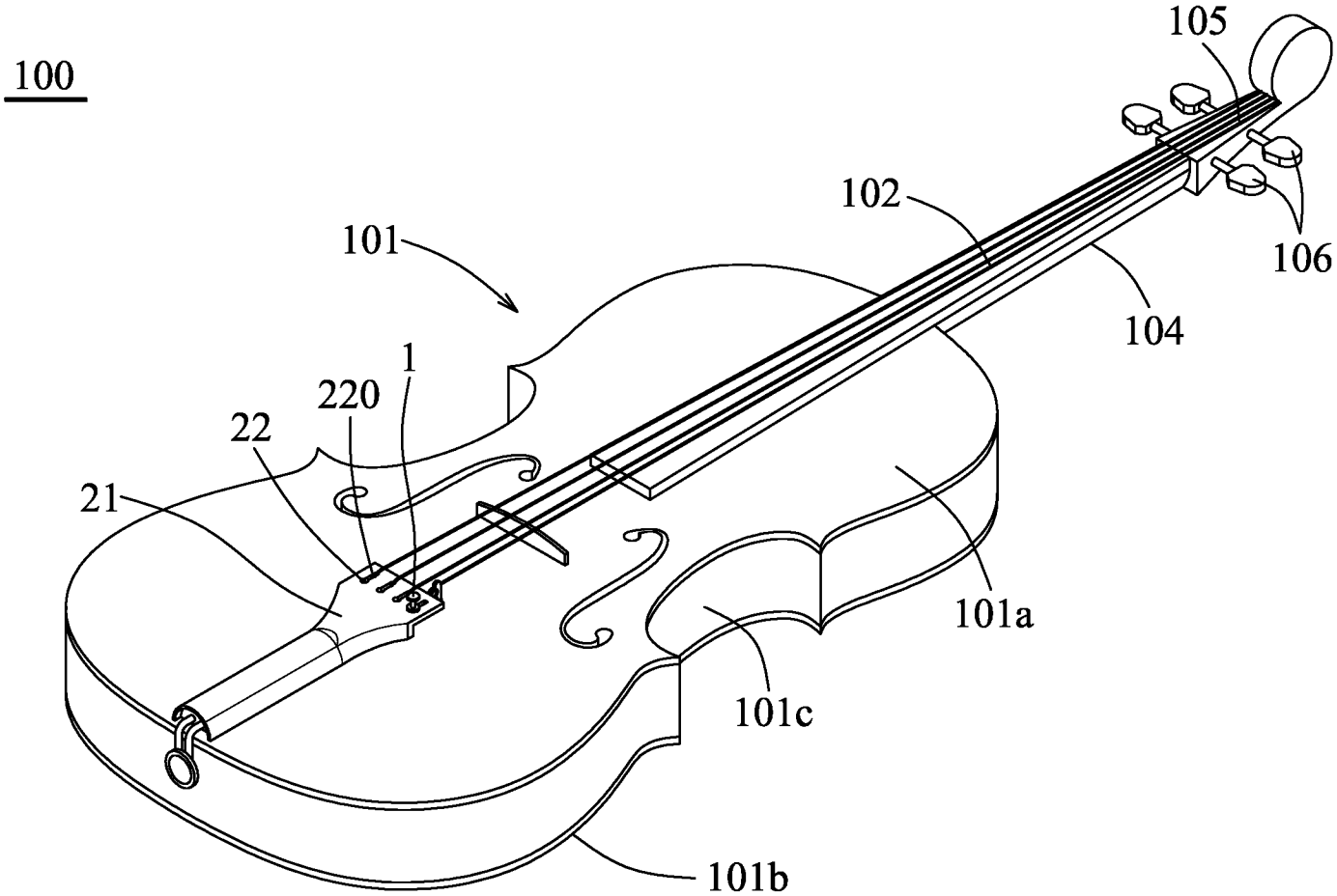
FIG. 1 is a perspective view illustrating a string instrument.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
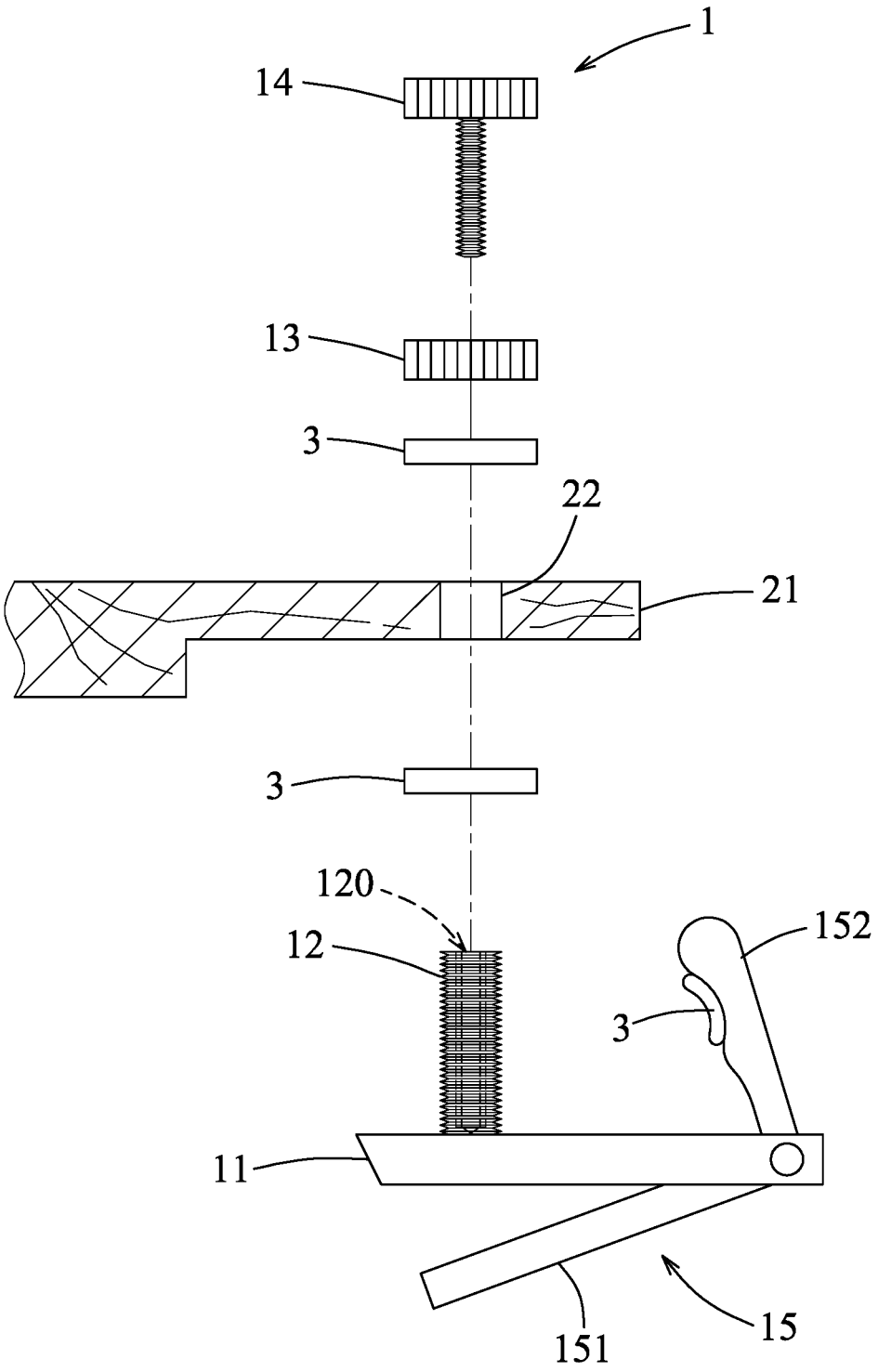
FIG. 2 is an exploded view illustrating one embodiment of an accessory assembly for a string instrument according to the disclosure.
Figure 3:
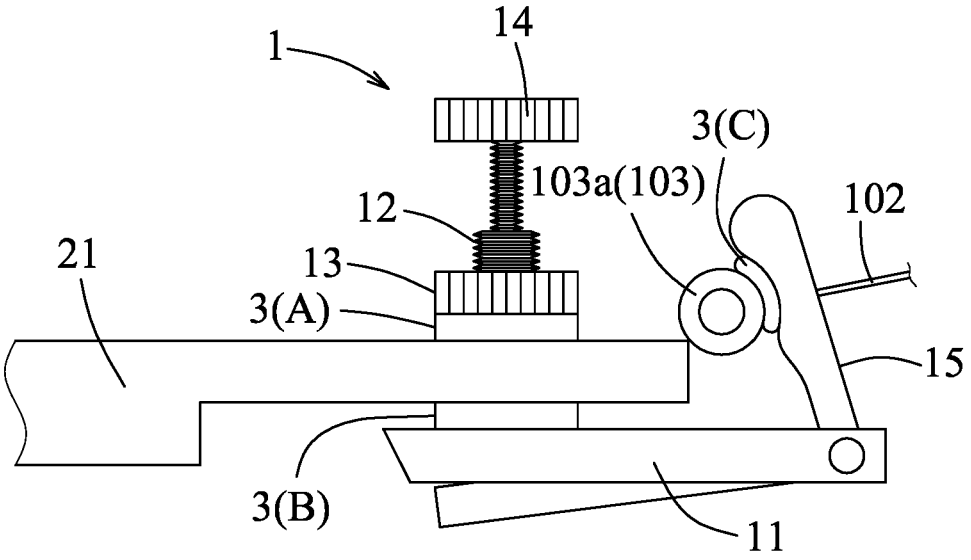
FIG. 3 is a schematic view illustrating the embodiment of the accessory assembly of FIG. 2.

Referring to FIGS. 1 to 3, one embodiment of an accessory assembly for a string instrument 100 according to this disclosure includes an accessory and plural sound purifiers 3. In the embodiment of FIGS. 1 to 3, the accessory is a fine tuner 1.

For illustrative purposes, the string instrument 100 is exemplified by a violin as shown in FIG. 1. However, the string instrument 100 can be a viola, a cello, or a bass, etc. in other embodiments. Briefly, the string instrument 100 includes a body 101. The body 101 has a front panel 101*a*, a back panel 101*b*, and a side wall 101*c* connected between the front panel 101*a* and the back panel 101*b* to form a sound box. The body 101 further has a neck 104 having one end connected to the front panel 101*a* and the side wall 101*c*, a peg box 105 connected to the other end of the neck 104, and plural pegs 106 (i.e., four pegs) mounted on the peg box 105 and plural strings 102 (i.e., four strings) corresponding respectively to the pegs 106.

In this embodiment, the body 101 further includes a tailpiece 21 mounted on the front panel 101*a*. The tailpiece 21 has four holes 22 corresponding respectively to the strings 102, and each of the holes 22 has a ditch 220 for holding a corresponding one of the strings 102. The fine tuner 1 is installed at one of the holes 22 (typically the hole corresponding to E-string) of the tailpiece 21. It is noted that the number of the fine tuner 1 installed on the tailpiece 21 can be multiple, depending on players' needs.

The strings 102 are winded on the pegs 106, respectively. Each string 102 has an end 103 in a form of a hoop surrounding a ball-shaped object 103*a*, of which the width is greater than that of the ditch 220 of the tailpiece 21. In another embodiment, the end 103 may be devoid of the ball-shaped object 103*a* and may be in a form of a knot or a loop end. In the case that the fine tuner 1 is installed on the hole 22, the end 103 of the string 102 is fastened on the fine tuner 1; in the case that there is no fine tuner 1, the end 103 of the string 102 is fastened on the tailpiece 21 directly.

In this embodiment, the fine tuner 1 includes (but not limited to) a base 11 placed under the tailpiece 21, a bolt 12, a nut 13, a tuning screw 14 and a string holder 15. The bolt 12 is formed with a threaded axial hole 120, is connected the base 11, and passes through the tailpiece 21. The nut 13 is disposed above the tailpiece 21, and is screwed down on the bolt 12 to fasten the base 11 under the tailpiece 21. The tuning screw 14 threadedly engages the threaded axial hole 120 of the bolt 12. The string holder 15 is pivoted on the base 11, and has a loading part 151 and a holding part 152 connected with the loading part 151 to form a L-shaped integral structure. The holding part 152 has a groove for holding the end 103 of the string 102. In order to tune the string 102, the tuning screw 14 is turned to push the loading part 151. As a result, the distance between the holding part 152 and the peg 106 changes, that modifies the tension of the string 2 accordingly as well. It is noted that styles and element details of the fine tuner 1 may be different.

In general, the fine tuner 1 is made of metals or fibre-reinforced plastic (FRP) of Young's modulus greater than 35 GPa. The tailpiece 21 is made of FRP or wood of Young's modulus greater than 17 GPa.

In this embodiment, there are three sound purifiers 3 included in the accessory assembly. A first one of the sound purifiers 3 is sandwiched between the nut 13 of the fine tuner 1 and the tailpiece 21 (hereinafter referred to as setting-point A), a second one of the sound purifiers 3 is sandwiched between the base 11 of the fine tuner 1 and the tailpiece 21 (hereinafter referred to as setting-point B), and a third one of the sound purifiers 3 is sandwiched between the holding part 152 of the string holder 15 of the fine tuner 1 and the end 103 of one of the strings 102 (hereinafter referred to as setting-point C).

Each of the sound purifiers 3 is made of a material of Young's modulus roughly equal to or less than 3.5 GPa. In this embodiment, each of the sound purifiers 3 is made of the material selected from the group consisting of sponge, rubber, foams, silicone, emulsions, and their combinations. Their Young's modulus is roughly equal to or less than 1 GPa. They may be designed in a form of, but not limited to, a circular disc, a ring, a block, or a ball.

Specifically, the sound purifier 3 placed at the setting-point A or B may be formed with a hole (not shown) for the tuning screw 14 to pass therethrough. For the sound purifier 3 placed at the setting-point C, since the holding part 152 typically has a slot (not shown), the sound purifier 3 should be also formed with a slot (not shown) for the string 102 to slip therein such that the ball-shaped object 103*a* exerts the pressure against the holding part 152. In other embodiments without the ball-shaped object 103*a*, there is no need to design a slot on the sound purifier 3. The loop end can simply surround on the holding part 152.

Figure 4:
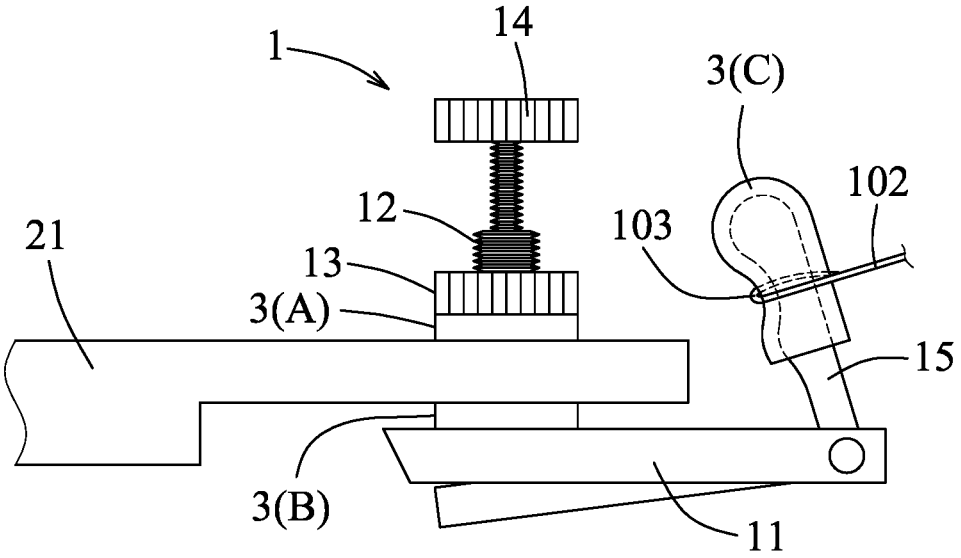
FIG. 4 is a schematic view illustrating one embodiment of an accessory assembly for a string instrument according to the disclosure.

Referring to FIG. 4, in another embodiment, the sound purifier 3 sandwiched between the string holder 15 and the end 103 of one of the strings 102 may be designed as a cover to envelop on the end of the string holder 15.

Speaking of the function of the sound purifiers, a conventional fine tuner mounted on the tailpiece 21 always vibrates with the string 102 when it is being played. The metallic nature of the fine tuner conducts the vibrational energy from the string 102 to the tailpiece 21 very effectively, creating unnecessary energy loss. In this embodiment, the sound purifiers 3 functionally reduce the vibration of the fine tuner 1. In addition, the sound purifiers 3 effectively cause the acoustic insulation between the tailpiece 21 and the fine tuner 1 and/or between the string 102 and the fine tuner 1. As a result, the unnecessary sound from the vibration of the tailpiece and from the fine tuner is damped. Therefore, the sound purifiers 3 not only enhance the volume of the sound from the string 102 but also purify the sound profile, making the sound profile more centralized to the strings only.

The effect of the accessory assembly of a fine tuner 1, a tailpiece 21, and the sound purifiers 3 has been scrutinized by two professional luthiers in Taiwan. The accessory assembly was installed and tested on their violins and cellos. A stronger sound volume and a better sound profile engaged by the accessory assembly on their instruments were obviously perceptible by their bare ears. It is arguable that the enhancement of the sound quality engaged by the accessory assembly doubles the market value of their instruments, according to their personal evaluations and estimations.

Figure 5:
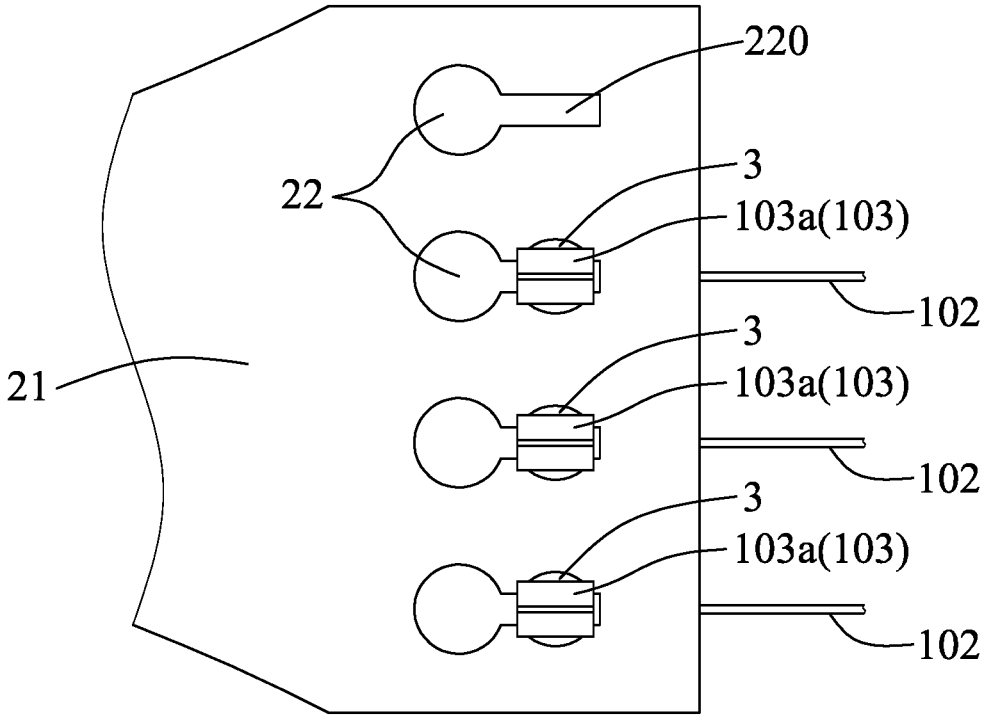
FIG. 5 is a schematic view illustrating one embodiment of an accessory assembly for a string instrument according to the disclosure.

Referring to FIG. 5, one embodiment of an accessory assembly for the string instrument 100 according to this disclosure is illustrated. In this embodiment, the accessory assembly includes an accessory that is the tailpiece 21 in this embodiment, and plural sound purifiers 3. It is noted that the tailpiece 21 is defined as the accessory in this embodiment, rather than a part of the body 101 of the string instrument 100.

In this embodiment, the end 103 of the string 102 is secured to the tailpiece 21 directly and not through the fine tuner 1, and each of the sound purifiers 3 is sandwiched between the tailpiece 21 and the ball-shaped object 103*a* of a corresponding one of the strings 102.

Each of the sound purifiers 3 is designed in a form of a circular disc, a block or a ball with a tiny hole or slot (not shown) for the string 102 to pass therethrough, such that the ball-shaped object 103*a* of the string 102 presses against the surface of the sound purifier 3.

In another embodiment, the accessory of the accessory assembly for the string instrument 100 is a string 102. It is noted that the string 102 is defined as the accessory in this embodiment, rather than a part of the body 101 of the string instrument 100, while the tailpiece 21 is defined as a part of the body 101 of the string instrument 100 in this embodiment.

The conventional tailpiece, contacting the string 102 directly, would vibrate with the string 102 when the string 102 is being played. The vibrational energy of the string 102 transfers to the conventional tailpiece; this results in inevitable energy loss of the string 102. The volume of the sound is weakened, and sound contamination happens because of the vibration of the conventional tailpiece. In this embodiment, the sound purifiers 3 acoustically insulate the ends 103 of the strings 102 from the tailpiece 21. The acoustic insulation by the sound purifiers 3 reduces the energy loss of the strings 102 and the sound contamination from the tailpiece 21. The sound volume of the strings 102 increases accordingly.

Figure 6:
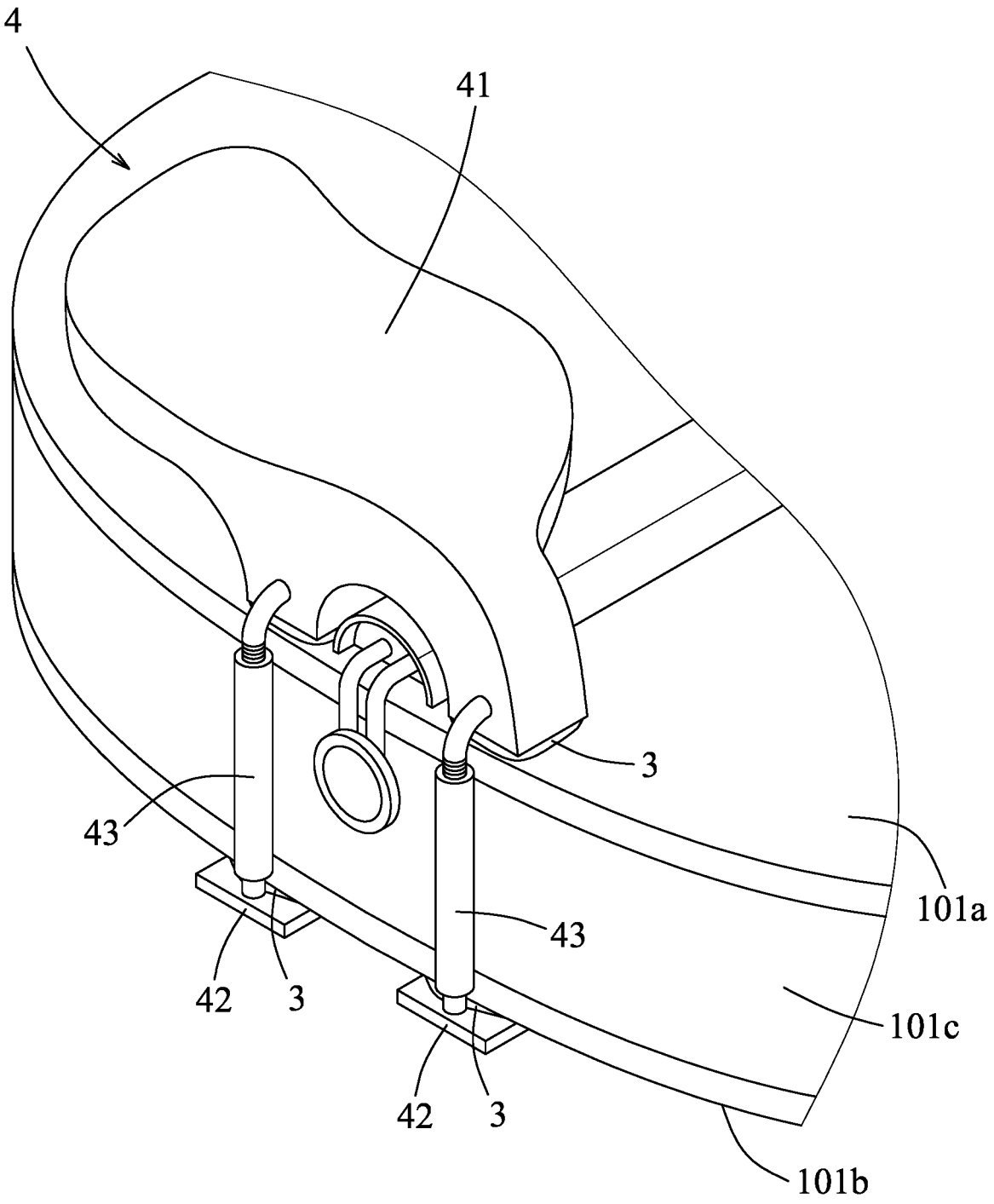
FIGS. 6 and 7 are fragmentary views illustrating one embodiment of an accessory assembly for a string instrument according to the disclosure.
Figure 7:
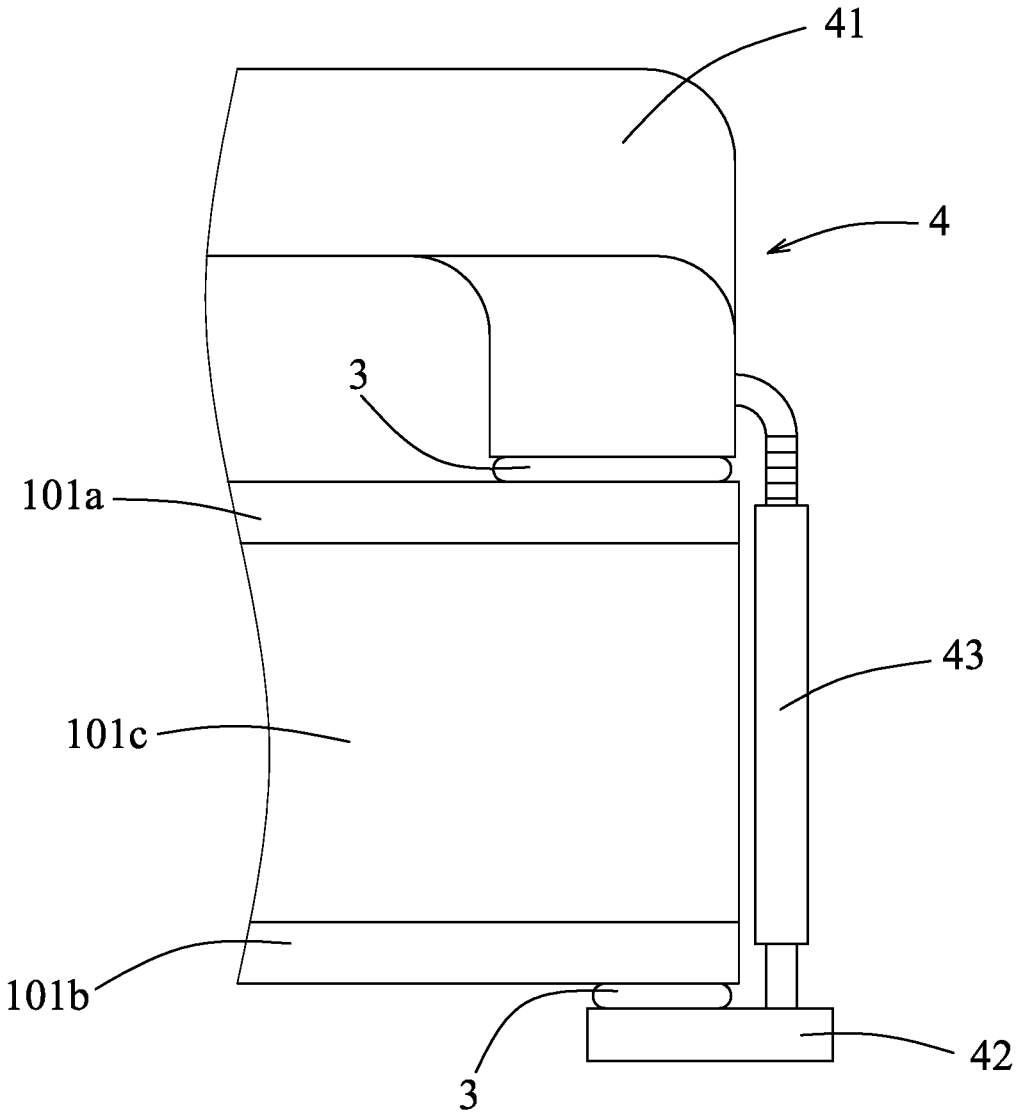

Referring to FIGS. 6 and 7, one embodiment of an accessory assembly for the string instrument 100 according to this disclosure is illustrated. The accessory assembly includes an accessory that is a chinrest device 4 in this embodiment, and sound purifiers 3. The string instrument 100 may be a violin or a viola.

The chinrest device 4 includes a chin rest 41, two holding feet 42, and two turnbuckle clamp 43. The chin rest 41 is disposed on the front panel 101*a* of the body 101 with, but not limited to, two touch points. Each of the holding feet 42 is disposed under the back panel 101*b*. The two turnbuckle clamps 43 are connected respectively to the two holding feet 42 and buckle on the chin rest 41, such that the chin rest 41 and the holding feet 42 are mounted on the body 101 of the string instrument 100.

Each sound purifier 3 is either sandwiched between the chin rest 41 and the front panel 101*a* or sandwiched between one of the holding foot 42 and the back panel 101*b*. Specifically, in this embodiment, there are two sound purifiers 3 placed under the chin rest 41 (front ones), and two sound purifiers 3 placed on the holding feet 42 (back ones). Each of the front ones is sandwiched between the touch point of the chin rest 41 and the front panel 101*a* of the body 101. Each of the back ones is sandwiched between the holding foot 42 and the back panel 101*b* of the body.

For example, the chin rest 41 is made of wood of Young's modulus greater than 17 GPa or FRP of Young's modulus greater than 35 GPa. The holding feet 42 is made of metal.

It is noted that a conventional chinrest device reduces the vibration of the body 101 of the string instrument 100. In this embodiment, the sound purifiers 3 provides better acoustic insulation for the body 101 from the chinrest device 4 to further diminish the reduction of the vibration of the body 101. In other words, the sound quality is enhanced because of the restoration of the vibration of the body 101.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. An accessory assembly for a string instrument, the string instrument including a body, the body of the string instrument including a front panel and a tailpiece mounted on the front panel, said accessory assembly comprising:

an accessory that is configured to be installed on the body and that is made of a material of Young's modulus greater than 12 GPa; and at least one sound purifying member that is made of a material of Young's modulus less than 3.5 GPa and that is configured to be sandwiched between said accessory and the body, wherein said accessory is a fine tuner that includes:

a base configured to be placed under the tailpiece;

a bolt connected to and extending upwardly from said base, and being configured to pass through the tailpiece; and a nut configured to be disposed above the tailpiece and to be screwed down on said bolt to fasten said base under the tailpiece, wherein each of said at least one sound purifying member is configured to be sandwiched between the tailpiece of the body and either of said nut or said base of said fine tuner.

2. An accessory assembly for a string instrument, the string instrument including a body that includes a fine tuner, the fine tuner having a base and a string holder mounted on and moveable relatively to the base, said accessory assembly comprising:

an accessory that is configured to be installed on the body and that is made of a material of Young's modulus greater than 12 GPa; and at least one sound purifying member that is made of a material of Young's modulus less than 3.5 GPa and that is configured to be sandwiched between said accessory and the body, wherein said accessory is a string having an end in a form of a hoop surrounding a ball-shaped object, and wherein said at least one sound purifying member is configured to be sandwiched between said ball-shaped object of the end of the string and the string holder of the fine tuner.

3. An accessory assembly for a string instrument, the string instrument including a body, the body of the string instrument including a front panel and a tailpiece mounted on the front panel, said accessory assembly comprising:

an accessory that is configured to be installed on the body and that is made of a material of Young's modulus greater than 12 GPa; and at least one sound purifying member that is made of a material of Young's modulus less than 3.5 GPa and that is configured to be sandwiched between said accessory and the body, wherein said accessory is a string having an end that is configured to be mounted on the tailpiece;

wherein said at least one sound purifying member is configured to be sandwiched between said end of said string and the tailpiece.

4. The accessory assembly of claim 3, the body of the string instrument including a front panel and a back panel, said accessory assembly further comprising another accessory that is a chinrest device that includes:

a chin rest configured to be disposed on the front panel of the body;

at least one holding foot configured to be disposed substantially under the back panel of the body;

at least one turnbuckle clamp connected respectively to said at least one holding foot, and configured to buckle on said chin rest such that said chin rest and said holding foot are mounted on the body of the string instrument; and said accessory assembly further comprising a first sound purifying member configured to be sandwiched between said chin rest and the front panel of the body, and a second sound purifying member configured to be sandwiched between said holding foot and the back panel of the body.

5. The accessory assembly of claim 3, wherein each of said at least one sound purifying member is made of a material of Young's modulus less than 1 GPa.

6. The accessory assembly of claim 3, wherein each of said at least one sound purifying member is made of a material selected from the group consisting of sponge, rubber, foams, silicone, emulsions and their combinations.

* * * * *